US009525246B2

(12) United States Patent
Lane et al.

(10) Patent No.: US 9,525,246 B2
(45) Date of Patent: Dec. 20, 2016

(54) PRINTED CIRCUIT BOARD CONNECTOR ASSEMBLY HAVING CONTACT SHIELD WITH INTEGRAL SECURING MEMBERS

(71) Applicant: Tyco Electronics Corporation, Berwyn, PA (US)

(72) Inventors: David James Lane, Middletown, PA (US); Douglas John Hardy, Middletown, PA (US); John Wesley Hall, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 33 days.

(21) Appl. No.: 14/269,800

(22) Filed: May 5, 2014

(65) Prior Publication Data

US 2015/0318643 A1 Nov. 5, 2015

(51) Int. Cl.

| | |
|---|---|
| ***H01R 13/648*** | (2006.01) |
| ***H01R 13/6594*** | (2011.01) |
| ***H01R 12/71*** | (2011.01) |
| *H01R 12/70* | (2011.01) |
| *H01R 13/514* | (2006.01) |

(52) U.S. Cl.

CPC ..... *H01R 13/6594* (2013.01); *H01R 12/716* (2013.01); *H01R 12/707* (2013.01); *H01R 13/514* (2013.01)

(58) Field of Classification Search

CPC ..... H01R 13/514; H01R 9/03; H01R 12/16
USPC ..... 439/607.35, 607.34, 607.4, 540.1, 717
See application file for complete search history.

(56) References Cited

U.S. PATENT DOCUMENTS 5,975,954 A * 11/1999 Wu ..... H01R 23/6873 439/607.35
6,299,487 B1 * 10/2001 Lopata ..... H01R 13/65802 439/607.01
6,447,311 B1 * 9/2002 Hu ..... H01R 23/6873 439/108
6,520,799 B1 * 2/2003 Cheng ..... H01R 13/7172 439/541.5

(Continued)

FOREIGN PATENT DOCUMENTS

WO 04/001907 A1 12/2003

OTHER PUBLICATIONS

Drawing No. SD-49616-001, HSAUTOLINK, R/A Header Type-A, Apr. 25, 2008,1 pg, Molex Incorporated.

(Continued)

*Primary Examiner* — Abdullah Riyami
*Assistant Examiner* — Nader Alhawamdeh

(57) ABSTRACT

A connector assembly configured to electrically and mechanically mate to a printed circuit board (PCB) may include a housing including a first ganging feature on a first side, and a second ganging feature on a second side that is opposite from the first side. The second ganging feature may be reciprocal to the first ganging feature. The first and second ganging features may be parallel to and oriented and aligned with a longitudinal axis of the housing. The assembly may include a contact shield retained by the housing. The contact shield may include a main body and at least one securing member configured to secure the connector assembly to the PCB. The securing member(s) may be integrally formed together with the main body from a single piece of material.

15 Claims, 3 Drawing Sheets

(56) References Cited

U.S. PATENT DOCUMENTS 7,097,504 B2 * 8/2006 Kan ..... H01R 23/6873 439/607.35
7,632,145 B1 * 12/2009 Lin ..... H01R 13/6597 439/607.32
8,079,882 B2 * 12/2011 Bailey ..... H01R 13/514 439/717
8,142,225 B2 * 3/2012 Yu ..... H01R 12/725 439/607.35
8,202,123 B1 * 6/2012 Lin ..... H01R 13/516 439/607.35
8,262,414 B1 * 9/2012 Li ..... H01R 13/6273 439/607.35
8,323,057 B2 * 12/2012 Ho ..... H01R 12/725 439/607.4
8,366,486 B1 * 2/2013 Lan ..... H01R 13/6582 439/607.35
8,662,928 B1 * 3/2014 Xie ..... H01R 13/6594 439/607.35
8,721,364 B2 * 5/2014 Lai ..... H01R 27/02 439/540.1
8,790,138 B2 * 7/2014 Wang ..... H01R 27/02 439/607.4
2002/0115346 A1 * 8/2002 Yip ..... H01R 13/6585 439/607.27
2010/0240256 A1 * 9/2010 Bailey ..... H01R 13/514 439/625
2011/0065325 A1 3/2011 Hsu et al.

OTHER PUBLICATIONS

Drawing No. C-2208408, USCAR30, Mini USB-B-Header 180 Deg. TH, Rev. A9, Jul. 7, 2013, 1pg, TE Connectivity.
Drawing No. 2203947, USCAR30, Mini USB-B Header, 90 Deg, TH, Rev. A, Jul. 28, 2013, 1pg, TE Connectivity.
International Search Report, International Application No. US2015/028979, International Filing Date, May 4, 2015.

* cited by examiner

PRINTED CIRCUIT BOARD CONNECTOR ASSEMBLY HAVING CONTACT SHIELD WITH INTEGRAL SECURING MEMBERS

BACKGROUND OF THE DISCLOSURE

Embodiments of the present disclosure generally relate to electrical connector assemblies, and, more particularly, to electrical connector assemblies having contact shields with integral securing members.

Right angle connectors have been used to connect printed circuit boards. A typical right angle connector may include a plurality of receiving terminals oriented at a right angle to a number of a plurality of pins.

USCAR30 is a standard for Universal Serial Bus (USB) connectors for use in automotive applications. A known USCAR30 right angle (ninety degree) header PCB connector includes a housing that retains a contact shield. The shield is configured to retain and shield electrical contacts having terminals that connect to pins at right angles. Typically, separate and distinct solder nails that are used to connect the housing to the PCB are configured to be retained within reciprocal openings formed in a PCB. Moreover, the solder nails are typically separate and distinct loose pieces, which may be misplaced or mis-positioned, that are manufactured and packaged separately.

The housings of a known ninety degree connector include ganging structures that allow each housing to be secured to another housing. As such, the housings may provide a modular assembly. Notably, the ganging structures are typically perpendicular to a longitudinal axis of the housing. It has been found that the ganging structures on the housing require specialized tools to form. For example, specialized side-action tooling is typically required to separately form the ganging structures.

As can be appreciated, the process of forming the shield and the housing of a typical ninety degree connector may be time and labor intensive, thereby increasing the cost of production for each connector. The shield and separate solder nails are typically separately affixed to the housing. Further, the housing that is configured to receive the shield is typically formed using complicated tooling in order to form ganging features. As can be appreciated, the process of forming a typical housing of a USCAR30 connector with ganging features requires complex tooling, thereby increasing the cost of production for each connector. Additionally the use of separate solder nails increases the cost of the finished connector in that additional components are used.

BRIEF DESCRIPTION OF THE DISCLOSURE

Certain embodiments of the present disclosure provide a connector assembly that is configured to electrically and mechanically mate to a printed circuit board (PCB). The connector assembly may include a contact shield retained by a housing. The contact shield may include or otherwise retain a dielectric component that retains one or more electrical contacts. Accordingly, the contact shield, which may include the dielectric component, may be configured to retain one or more electrical contacts. The contact shield may include a main body and at least one securing member configured to secure the connector assembly to the PCB. The securing member(s) may be integrally formed with the main body. For example, the main body and the securing member(s) may be integrally formed together from a single piece of material. In at least one embodiment, the main body and the securing members(s) may be stamped and formed from a single piece of metal. In at least one embodiment, the main body and the securing member(s) may be integrally molded and formed together from a single mold, such as by molten metal being injected or poured into a single mold and cooling and hardening within the single mold.

In at least one embodiment, the connector assembly may include two inner securing members and two outer securing members. Each of the two inner securing members may include a planar beam that is coplanar with a lateral wall of the contact shield. Each of the two outer securing members may be outside of a plane of the lateral wall of the contact shield. The securing member(s) may include a solder nail or tail configured to be received and retained within a reciprocal opening formed within the PCB.

The housing may include a first ganging feature on a first side, and a second ganging feature on a second side that is opposite from the first side. The second ganging feature may be reciprocal to the first ganging feature. That is, the first ganging feature may be configured to securely connect to a second ganging feature of another housing, or vice versa. The first and second ganging features may be parallel to a longitudinal axis of the housing. The first and second ganging features may be oriented and aligned with a longitudinal axis of the housing.

Certain embodiments of the present disclosure provide a connector assembly that is configured to electrically and mechanically mate to a printed circuit board (PCB). The connector assembly may include a housing having a first ganging feature on a first side, and a second ganging feature on a second side that is opposite from the first side. The second ganging feature may be reciprocal to the first ganging feature. The first and second ganging features may be parallel to a longitudinal axis of the housing.

Certain embodiments of the present disclosure provide a connector assembly that may include a housing and a contact shield. The housing may include a first ganging feature on a first side, and a second ganging feature on a second side that is opposite from the first side. The second ganging feature is reciprocal to the first ganging feature. The first and second ganging features are parallel to and oriented and aligned with a longitudinal axis of the housing. The contact shield is retained by the housing, and is configured to retain one or more electrical contacts. The contact shield includes a main body and at least one securing member configured to secure the connector assembly to the PCB. The securing member(s) may be integrally formed together with the main body from a single piece of material.

DETAILED DESCRIPTION OF THE DISCLOSURE

Figure 1:
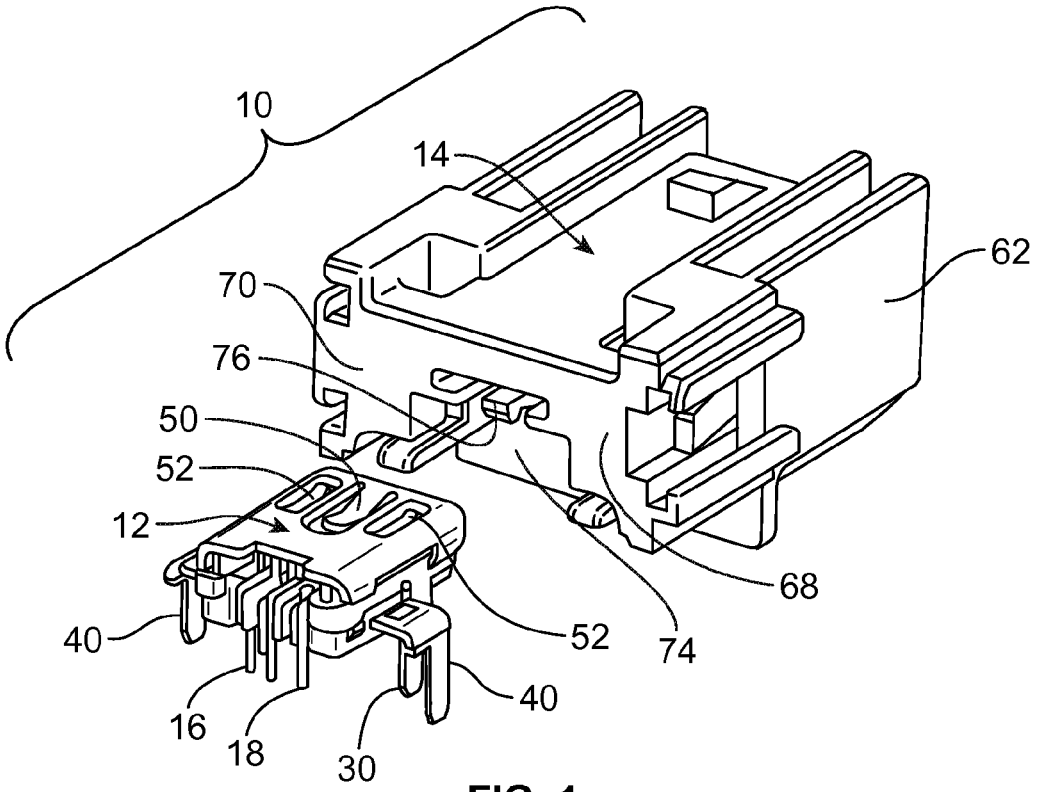
FIG. 1 illustrates a perspective rear exploded view of a printed circuit board connector assembly, according to an embodiment of the present disclosure.

FIG. 1 illustrates a perspective rear exploded view of a printed circuit board (PCB) connector assembly 10, according to an embodiment of the present disclosure. The PCB connector assembly 10 includes a contact shield 12 that is configured to be secured within a housing 14. The contact shield 12 may include or otherwise retain a dielectric component that retains one or more electrical contacts 16 having pins 18 that connect to terminals (hidden from view in FIG. 1). Accordingly, the contact shield 12 may retain more electrical contact(s) 16. The pins 18 may connect to the terminals at right angles. The electrical contacts 16 may be integrally formed pieces of metal that are electrically conductive and configured to allow electrical signals to pass therethrough. The pins 18 are configured to be received and retained within reciprocal through-holes (not shown) formed in a first PCB. The terminals are configured to electrically mate with terminals of another connector, for example, which may, in turn, be connected to a universal serial bus (USB) cable, for example.

Figure 2:
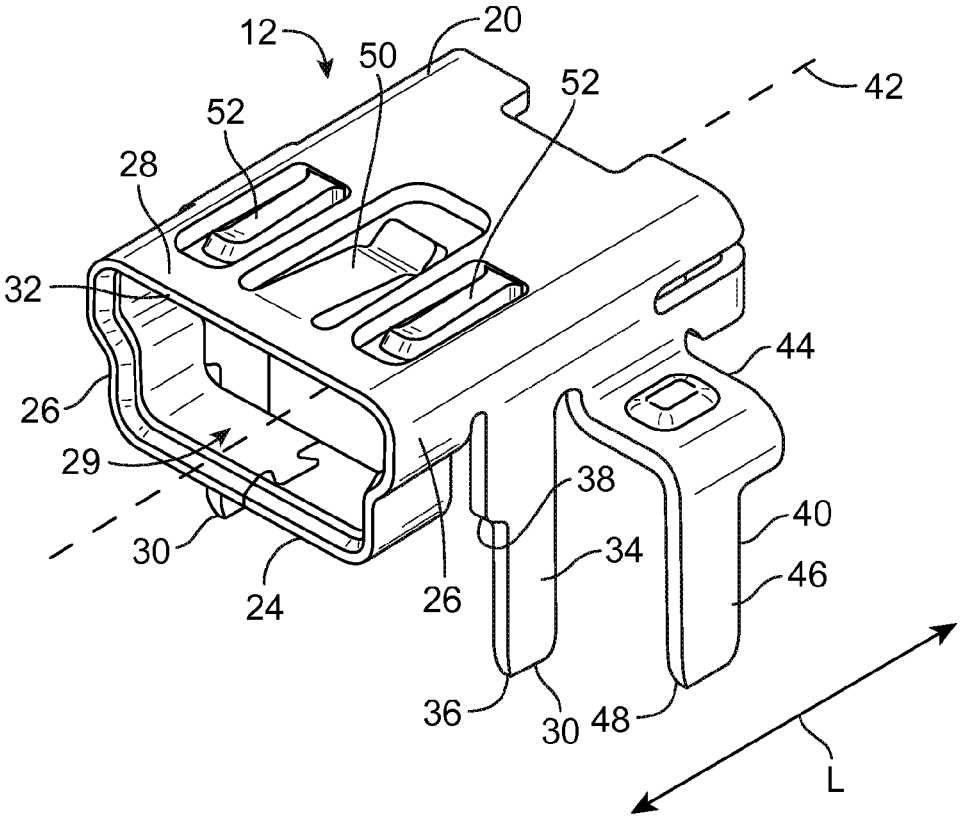
FIG. 2 illustrates a perspective front view of a contact shield, according to an embodiment of the present disclosure.

FIG. 2 illustrates a perspective front view of the contact shield 12, according to an embodiment of the present disclosure. Referring to FIGS. 1 and 2, the contact shield 12 may be integrally formed as a single piece of material, such as a metal. The contact shield 12 includes a main body 20 having a base 24 connected to lateral walls 26, which, in turn, connect to a top wall 28, thereby defining a central channel 29 therebetween. Terminals of electrical contacts are configured to extend into the central channel 29. As shown, the base 24 may not extend over an entire length L of the contact shield 12. Instead, the base 24 may be proximate to only an edge of the contact shield 12. Optionally, the base 24 may extend over a greater (or lesser) distance than shown in FIG. 2.

Inner securing members 30 may extend downwardly from the lateral walls 26 and spaced apart from an interface edge 32. The inner securing members 30 may be legs, arms, tails, nails, beams, posts, studs, barbs, or the like that are configured to be received and retained within reciprocal openings formed in a PCB. For example, the inner securing members 30 may be solder legs. The inner securing members 30 may be positioned within the reciprocal openings of the PCB and soldered therein to securely anchor the contact shield 12 to the PCB. As such, the inner securing members 30 may be solder tails or nails. Each inner securing member 30 may include a planar beam 34 having a distal beveled lead-in tip 36, which may be configured to align and orient the inner securing members 30 into the reciprocal openings formed in the PCB. Each inner securing member 30 may also include an abutting ridge 38 that may be configured to abut into an upper surface of the PCB. The abutting ridge 38 may be configured to control the depth to which the inner securing member 30 is inserted into the reciprocal opening of the PCB. For example, the abutting ridge 38 may be too large to fit into the reciprocal opening.

As shown, each inner securing member 30 may be coplanar with an outer surface of a respective lateral wall 26. Alternatively, the inner securing members 30 may be offset with respect to the lateral walls 26, such as through beams that are positioned outside (or inside) of a plane of the lateral walls 26.

The contact shield 12 may also include outer securing members 40, such as legs, tails, nails, beams, studs, posts, or the like that are configured to be received and retained within reciprocal openings formed in a PCB. For example, the outer securing members 40 may be solder legs. The outer securing members 40 may be positioned within the reciprocal openings of the PCB and soldered therein to securely anchor the contact shield 12 to the PCB. The outer securing members 40 are outside of the inner securing members 30 in relation to a central longitudinal axis 42 of the contact shield 12. Each outer securing member 40 may include an extension beam 44 that may be perpendicular to the lateral wall 26. The extension beam 44 connects to a planar beam 46, which may be perpendicular to the extension beam 44 and parallel with the lateral wall 26. The planar retaining beam 46 may include a distal beveled lead-in tip 48, which may be configured to align and orient the outer securing members 40 into the reciprocal openings formed in the PCB. Alternatively, the securing members 40 may not be outer securing members, but may instead be aligned in the same planes as the inner securing members 30. For example, the securing members 40 may not include the extension beams 44. Also, alternatively, the securing members 30 may be outer securing members, while the securing members 40 may be inner securing members 40.

As shown, the contact shield 12 may include a total of two inner securing members 30 and two outer securing members 40. Alternatively, the contact shield 12 may include more or less inner and outer securing members than shown. For example, the contact shield 12 may include five or more securing members. As another example, the contact shield 12 may include three or less securing members.

Unlike known contact shields, the securing members 30 and 40 are integrally formed with the main body 20 as a single, contiguous piece without any securing interfaces (such as separable joints, adhesives, or the like) positioned therebetween. For example, the securing members 30 and 40 may be integrally molded and formed as a single piece of metal. As another example, the securing members 30 and 40 may be stamped from a single piece of metal and formed as shown by bending, crimping, or the like the securing members 30 and 40 into position. Unlike known contact shields, the securing members 30 and 40 are not separate and distinct loose pieces that are separately affixed to the main body 20.

In at least one embodiment, the contact shield 12 may be integrally formed from a single piece of metal. For example, an entire contiguous body of the contact shield 12, including the main body 20 and the securing members 30 and 40, may be cut from a single planar sheet of metal. The single, contiguous body may then be bent, crimped, and otherwise formed to produce the contact shield 12, such as shown in FIG. 2.

In at least one embodiment, a single mold may be used to form the contact shield 12, including the main body 20 and the securing members 30 and 40. The single mold may include a separable construction having an inner cavity that defines the shape of the contact shield 12. A forming material, such as molten metal, may be poured or injected into the mold. The forming material is then allowed to cool and harden with the mold to form the contact shield 12. After the contact shield 12 is cooled and fully-formed, the mold may be opened and the formed contact shield 12 may be removed.

As shown in FIGS. 1 and 2, the top wall 28 of the main body 20 may include deflectable spring members 50 and 52 that are configured to provide a contact with another mating shield. More or less spring members than shown may be used.

Figure 3:
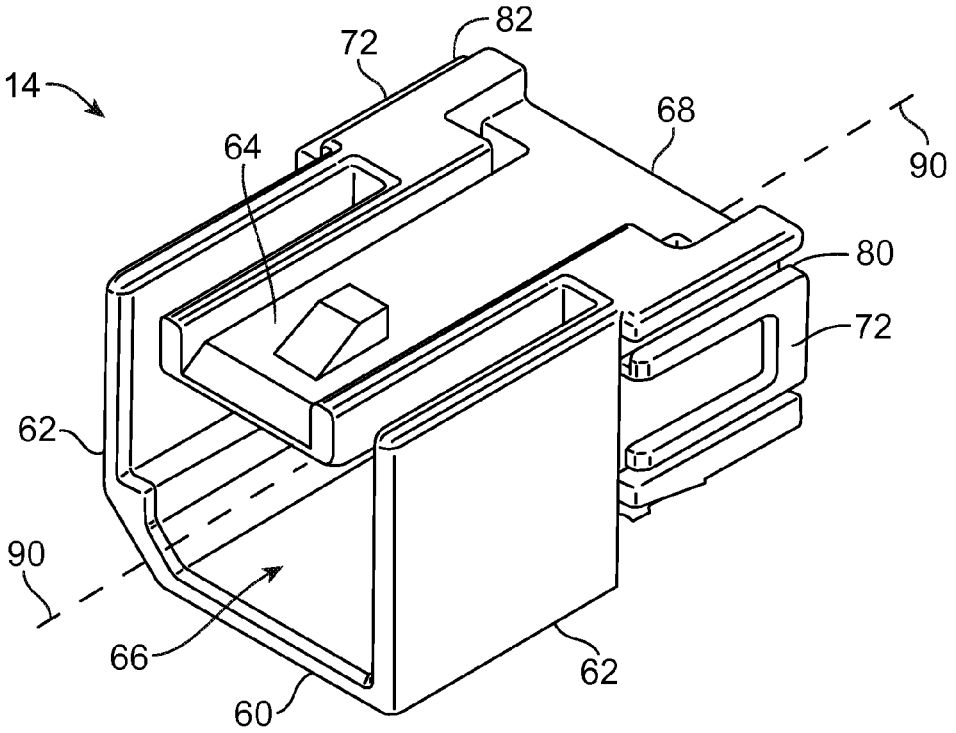
FIG. 3 illustrates a perspective front view of a housing, according to an embodiment of the present disclosure.

FIG. 3 illustrates a perspective front view of the housing 14, according to an embodiment of the present disclosure. The housing 14 may be an integrally formed and molded piece of dielectric material, such as an injection-molded plastic, for example. The housing 14 includes a base 60 connected to lateral walls 62, which in turn connect to an upper wall 64. An interface chamber 66 is defined between the base 60, the lateral walls 62, and the upper wall 64. The interface edge 32 of the contact shield 12 (shown in FIG. 2, for example) is configured to be retained within the interface chamber 66 so that contact terminals may be exposed therein in order to mate with other contact terminals, for example.

Referring to FIGS. 1 and 3, the housing 14 may also include a shield-retaining block 68 having a rear wall 70 integrally connected to lateral connecting or ganging walls 72. As shown in FIG. 1, a shield-receiving chamber 74 is formed through the rear wall 70. Reciprocal latching members 76 extend into the shield-receiving chamber 74 and are configured to securely mate with the deflectable spring members 50 and 52 and/or other features of the contact shield 12 to securely connect the contact shield 12 within the housing 14.

The lateral ganging walls 72 include housing-ganging features 80 and 82 that are configured to securely mate with housing-ganging features 82 and 80, respectively on another housing 14 in order to allow multiple housings 14 to be secured to one another. In this manner, the ganging features 80 and 82 provide a modular assembly that may include a desired number of housings 14, and therefore PCB connector assemblies.

As shown, the ganging features 80 and 82 are aligned and oriented to be parallel with a longitudinal axis 90 of the housing 14. For example, as shown in FIG. 3, the ganging features 80 and 82 are horizontally-oriented with respect to the housing 14. The ganging features 80 and 82 may be aligned with and extend along a length of each lateral ganging wall 72, as opposed to being perpendicularly oriented with respect to the length of each lateral ganging wall 72. For example, the ganging features 80 and 82 may not be vertically oriented with respect to the length of each lateral ganging wall 72. It has been found that aligning and orienting the ganging features 80 and 82 to be parallel with the longitudinal axis 90 of the housing 14 (such that the ganging features 80 and 82 are aligned with and extend along a length of each lateral ganging wall 72), allows the housing 14 to be integrally molded and formed as a single piece, without the need for separate and distinct tooling to form the ganging features 80 and 82. As such, unlike known housings, the housing 14 may be more amenable to mass production.

Figure 4:
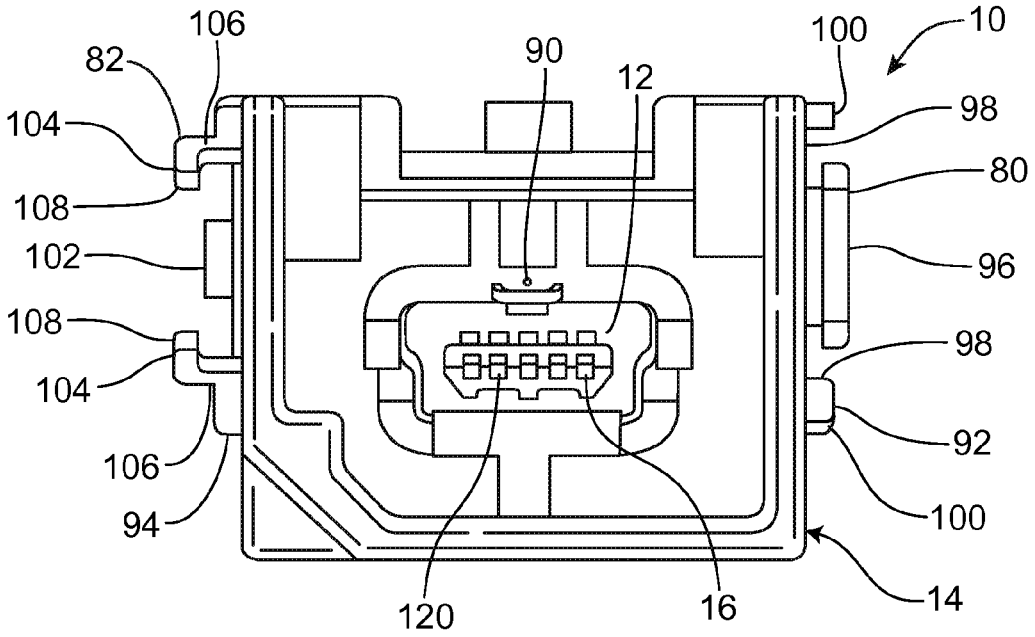
FIG. 4 illustrates a front view of a printed circuit board connector assembly, according to an embodiment of the present disclosure.
Figure 5:
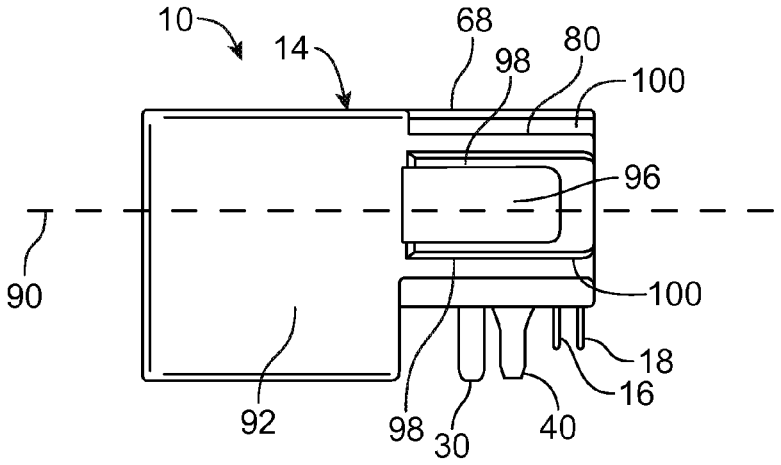
FIG. 5 illustrates a lateral view of a printed circuit board connector assembly, according to an embodiment of the present disclosure.
Figure 6:
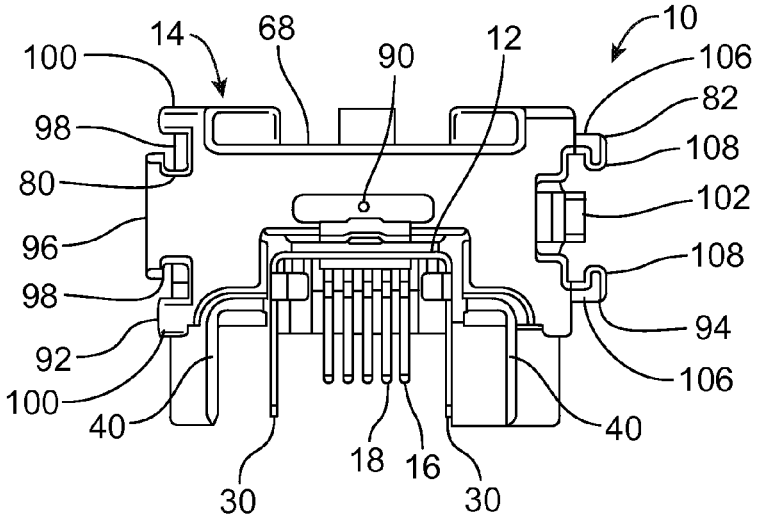
FIG. 6 illustrates a rear view of a printed circuit board connector assembly, according to an embodiment of the present disclosure.

FIG. 4 illustrates a front view of the PCB connector assembly 10, according to an embodiment of the present disclosure. FIG. 5 illustrates a lateral view of the PCB connector assembly 10, while FIG. 6 illustrates a rear view of the PCB connector assembly 10. Referring to FIGS. 4-6, the ganging feature 80 may extend from a first side 92 of the housing 14, while the ganging feature 82 may extend from a second side 94, which is opposite from the first side 92.

The ganging feature 80 may include a central longitudinal connecting beam 96 that is aligned with and oriented with respect to longitudinal axis 90 of the housing 14. Guide tracks 98 may be positioned above and below the connecting beam 96. The guide tracks 98 are defined between the connecting beam 96 and retaining ridges 100.

The ganging feature 82 is formed as a reciprocal feature that may be retained by the ganging feature 80. The ganging feature 82 includes a central latch 102 positioned between wall clips 104 having extension beams 106 integrally formed with perpendicular beams 108.

In order to modularly connect a first housing to a second housing, the ganging feature 80 is slid into the ganging feature 82 (or the ganging feature 82 is slid onto the ganging feature 80). During this movement, the wall clips 104 slide over the connecting beam 96. The housings continue to be slid towards one another until the central latch 102 latchably secures onto a reciprocal feature of the connecting beam 96, thereby securely connecting the housings together.

Accordingly, each housing 14 may be integrally formed and molded as a single piece with one side having one or more connecting or ganging members, such as the ganging feature 80, and an opposite side having one or more reciprocal, complimentary connecting ganging members, such as the ganging feature 82. The ganging features 80 and 82 are aligned and oriented to be parallel with respect to a central longitudinal axis 90 of the housing 14, which allows for the housing 14 to be integrally formed and molded a single piece, including the ganging features 80 and 82, without the use of a separate and distinct tool to form the ganging features.

Various other ganging features other than the ganging features 80 and 82 may be used. For example, one side of the housing 14 may include an outwardly extending fin that is parallel with the longitudinal axis 90, while the opposite side of the housing 14 includes a reciprocal channel configured to receive and retain another fin.

As shown in FIG. 4, contact terminals 120 of the electrical contacts 16 retained by the contact shield 12 may be positioned within the shield-retaining block 68. Alternatively, the contact terminals 120 may extend into the interface chamber 66 of the housing 14. As shown in FIG. 6, the contact pins 18 of the electrical contacts 16 extend downwardly below the shield-retaining block 68 of the housing 14 at a right angle with respect to the contact terminals 120.

Further, as shown in FIGS. 5 and 6, the securing members 30 and 40 extend below the shield-retaining block 68 of the housing 14. The securing members 30 and 40 are configured to be received and retained within a PCB, for example.

Figure 7:
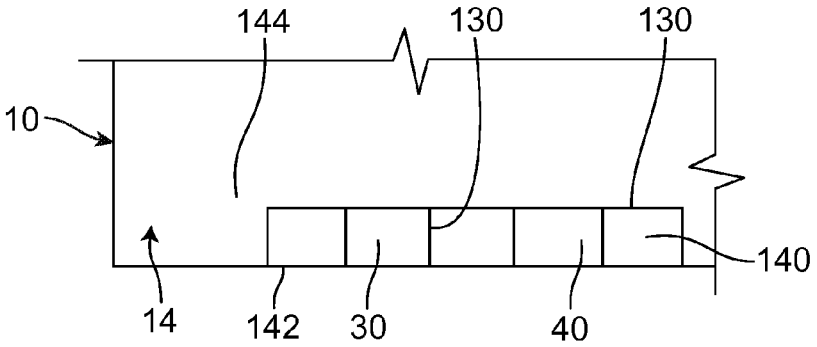
FIG. 7 illustrates a transverse cross-sectional view of securing members of a printed circuit board connector assembly secured within through-holes of a printed circuit board, according to an embodiment of the present disclosure.

FIG. 7 illustrates a transverse cross-sectional view of the securing members 30 and 40 of the PCB connector assembly 10 secured within through-holes 130 of a printed circuit board 140, according to an embodiment of the present disclosure. As shown, a front end 142 of the PCB 140 may abut into a rear wall of an interface shroud 144 of the housing 14. A reciprocal feature of another housing may be configured to mate with the interface shroud 144. For example, a plug of another housing may be secured into an interface chamber defined by the interface shroud 144 in order to mate contact terminals together.

Referring to FIGS. 1-7, the PCB connector assembly 10 may be configured as a right angle connector. Alternatively, the PCB connector assembly 10 may be configured in various other orientations. For example, the PCB connector assembly 10 may be configured as an in-line or vertical connector assembly in which the contact shield retains straight electrical contacts (as opposed to bent contacts).

Embodiments of the present disclosure provide a PCB connector assembly including a contact shield that may be integrally formed from a single piece of material, for example. Securing members may be integrally formed with a main body. As such, the contact shield may not use separate and distinct securing members that are separately affixed to the main body. Instead, the securing members integrally extend from the main body. Accordingly, the manufacturing process may be simplified and more efficient.

Additionally, embodiments of the present disclosure provide a PCB connector assembly including a housing having ganging features that may be integrally molded and formed without the use of a distinct tool, such as side action tooling. The ganging features may be oriented and aligned with a longitudinal axis of the housing.

Embodiments of the present disclosure provide a connector assembly including a contact shield having a main body and securing members formed as a single component (as opposed to a main body and separate and distinct securing members). The main body and securing members may be formed from (and connected with respect to) a single piece of material, such as a single piece of metal.

Also, embodiments of the present disclosure provide a housing having ganging features that may be oriented 90 degrees in relation to known housings. For example, known ganging features are vertically-oriented with respect to (or otherwise perpendicular to a longitudinal axis of) the housing, while embodiments of the present disclosure provide ganging features that may be horizontally-oriented with respect to (or otherwise parallel and aligned with the longitudinal axis of) the housing. Orienting the ganging features in this manner simplifies the tooling and manufacturing process.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A connector assembly configured to electrically and mechanically mate to a printed circuit board (PCB), the connector assembly, comprising: a housing; and a contact shield retained by the housing, wherein the contact shield includes a main body and a first inner securing member, a second inner securing member, a first outer securing member, and a second outer securing member that are configured to secure the connector assembly to the PCB, wherein the first and second inner securing members and the first and second outer securing members are integrally formed with the main body, wherein the first inner securing member and the first outer securing member extend from a first wall of the main body, and wherein the second inner securing member and the second outer securing member extend from a second wall of the main body that is opposite from the first wall; wherein each of the first and second inner securing members comprises a planar beam that is coplanar with the first wall and the second wall, respectively, and wherein each of the first and second outer securing members is outside of a plane of the first wall and the second wall, respectively.

2. The connector assembly of claim 1, wherein the main body and the first and second inner securing members and the first and second outer securing members are integrally formed together from a single piece of material.

3. The connector assembly of claim 1, wherein the main body and the first and second inner securing members and the first and second outer securing members are integrally molded and formed together from a single mold.

4. The connector assembly of claim 1, wherein each of the first and second inner securing members and the first and second outer securing members comprises a solder tail configured to be received and retained within a reciprocal opening formed within the PCB.

5. The connector assembly of claim 1, wherein the housing comprises:

a first ganging feature on a first side; and a second ganging feature on a second side that is opposite from the first side, wherein the second ganging feature is reciprocal to the first ganging feature.

6. The connector assembly of claim 5, wherein the first and second ganging features are parallel to a longitudinal axis of the housing.

7. The connector assembly of claim 5, wherein the first and second ganging features are oriented and aligned with a longitudinal axis of the housing.

8. A connector assembly configured to electrically and mechanically mate to a printed circuit board (PCB), the connector assembly, comprising: a housing including a first ganging feature on a first side, and a second ganging feature on a second side that is opposite from the first side, wherein the second ganging feature is reciprocal to the first ganging feature, wherein the first and second ganging features are parallel to a longitudinal axis of the housing; and a contact shield retained by the housing, wherein the contact shield is configured to retain one or more electrical contacts, wherein the contact shield includes a first inner securing member, a second inner securing member, a first outer securing member, and a second outer securing member that are configured to secure the connector assembly to the PCB, wherein the first inner securing member and the first outer securing member extend from a first wall of the contact shield, and wherein the second inner securing member and the second outer securing member extend from a second wall of the contact shield that is opposite from the first wall; wherein each of the first and second inner securing members comprises a planar beam that is coplanar with the first wall and the second wall, respectively, of the contact shield, and wherein each of the first and second outer securing members is outside of a plane of the first wall and the second wall, respectively, of the contact shield.

9. The connector assembly of claim 8, wherein each of the first and second inner securing members and the first and second outer securing members comprises a solder tail configured to be received and retained within a reciprocal opening formed within the PCB.

10. A connector assembly configured to electrically and mechanically mate to a printed circuit board (PCB), the connector assembly, comprising: a housing including a first ganging feature on a first side, and a second ganging feature on a second side that is opposite from the first side, wherein the second ganging feature is reciprocal to the first ganging feature, wherein the first and second ganging features are parallel to and oriented and aligned with a longitudinal axis of the housing; and a contact shield retained by the housing, wherein the contact shield includes a main body and a first inner securing member, a second inner securing member, a first outer securing member, and a second outer securing member that are configured to secure the connector assembly to the PCB, wherein the first inner securing member, the second inner securing member, the first outer securing member, and the second outer securing member are integrally formed together with the main body from a single piece of material, wherein the first inner securing member and the first outer securing member extend from a first wall of the main body, and wherein the second inner securing member and the second outer securing member extend from a second wall of the main body that is opposite from the first wall; wherein each of the first and second inner securing members comprises a planar beam that is coplanar with the first wall and the second wall, respectively, and wherein each of the first and second outer securing members is outside of a plane of the first wall and the second wall, respectively.

11. The connector assembly of claim 10, wherein the main body, the first inner securing member, the second inner securing member, the first outer securing member, and the second outer securing member are integrally molded and formed together from a single mold.

12. The connector assembly of claim 10, wherein each of the first and second inner securing members and the first and second outer securing members comprises a solder tail configured to be received and retained within a reciprocal opening formed within the PCB.

13. The connector assembly of claim 1, wherein a first distance between the first inner securing member and a longitudinal axis of the contact shield is less than a second distance between the first outer securing member and the longitudinal axis of the contact shield, and wherein a third distance between the second inner securing member and the longitudinal axis of the contact shield is less than a fourth distance between the second outer securing member and the longitudinal axis of the contact shield.

14. The connector assembly of claim 8, wherein a first distance between the first inner securing member and a longitudinal axis of the contact shield is less than a second distance between the first outer securing member and the longitudinal axis of the contact shield, and wherein a third distance between the second inner securing member and the longitudinal axis of the contact shield is less than a fourth distance between the second outer securing member and the longitudinal axis of the contact shield.

15. The connector assembly of claim 10, wherein a first distance between the first inner securing member and a longitudinal axis of the contact shield is less than a second distance between the first outer securing member and the longitudinal axis of the contact shield, and wherein a third distance between the second inner securing member and the longitudinal axis of the contact shield is less than a fourth distance between the second outer securing member and the longitudinal axis of the contact shield.

* * * * *